US005491916A

United States Patent [19]

Ingram et al.

[11] Patent Number: 5,491,916

[45] Date of Patent: Feb. 20, 1996

[54] ANIMATED DISPLAY

[75] Inventors: Kevin A. Ingram, Glenview; Marvin L. Adenau, Wadsworth, both of Ill.

[73] Assignee: Thomas A. Schutz Co., Inc., Morton Grove, Ill.

[21] Appl. No.: 209,553

[22] Filed: Mar. 10, 1994

[51] Int. Cl.[6] ..... G09F 19/00

[52] U.S. Cl. ..... 40/410; 40/406

[58] Field of Search ..... 40/406, 407, 409, 40/410, 414; 446/267; 417/423.14, 424.2; 415/206

[56] References Cited

U.S. PATENT DOCUMENTS

| | | | |
|---|---|---|---|
| 1,101,422 | 6/1914 | Fielding . | |
| 2,341,955 | 2/1944 | Smith | 40/410 X |
| 2,587,620 | 3/1952 | Hormann . | |
| 2,897,619 | 8/1959 | Zenz . | |
| 3,158,955 | 12/1964 | Sturgis . | |
| 3,243,183 | 3/1966 | Scranage . | |
| 4,028,830 | 6/1977 | Ottinger | 40/410 |
| 4,641,445 | 2/1987 | Rossi | 40/410 |
| 4,852,283 | 8/1989 | Teng | 40/410 X |
| 5,200,239 | 4/1993 | Chen . | |
| 5,291,674 | 3/1994 | Torrence | 40/410 |
| 5,313,727 | 5/1994 | Murray, Jr. | 40/410 |
| 5,396,723 | 3/1995 | Liu | 40/407 X |

FOREIGN PATENT DOCUMENTS

| | | | |
|---|---|---|---|
| 2249858 | 5/1992 | United Kingdom | 40/410 |

*Primary Examiner*—Peter M. Cuomo
*Assistant Examiner*—James O. Hansen
*Attorney, Agent, or Firm*—Wood, Phillips, VanSanten, Clark & Mortimer

[57] ABSTRACT

An animated display having a case defining a display chamber with a top and bottom. An object is provided within the display chamber so as to be visible from externally of the case. Structure is provided for continuously circulating a plurality of discrete particles through the display chamber in a pattern that extends through in excess of 180° around a vertical axis extending through the object.

28 Claims, 2 Drawing Sheets

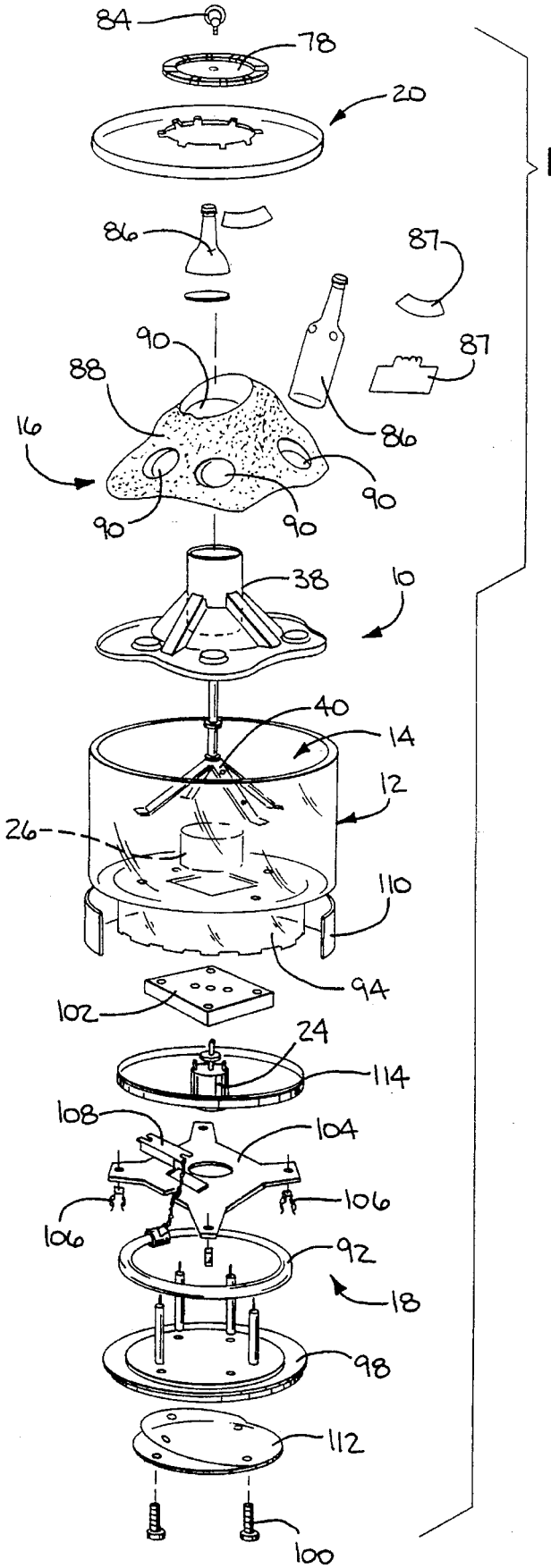
FIG. 1
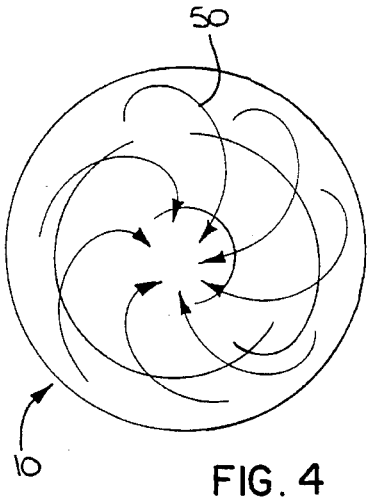
FIG. 4
FIG. 5
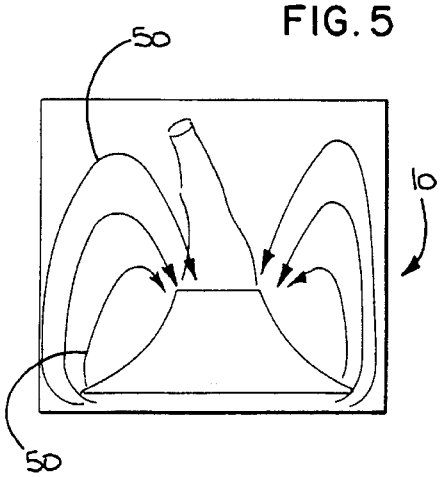

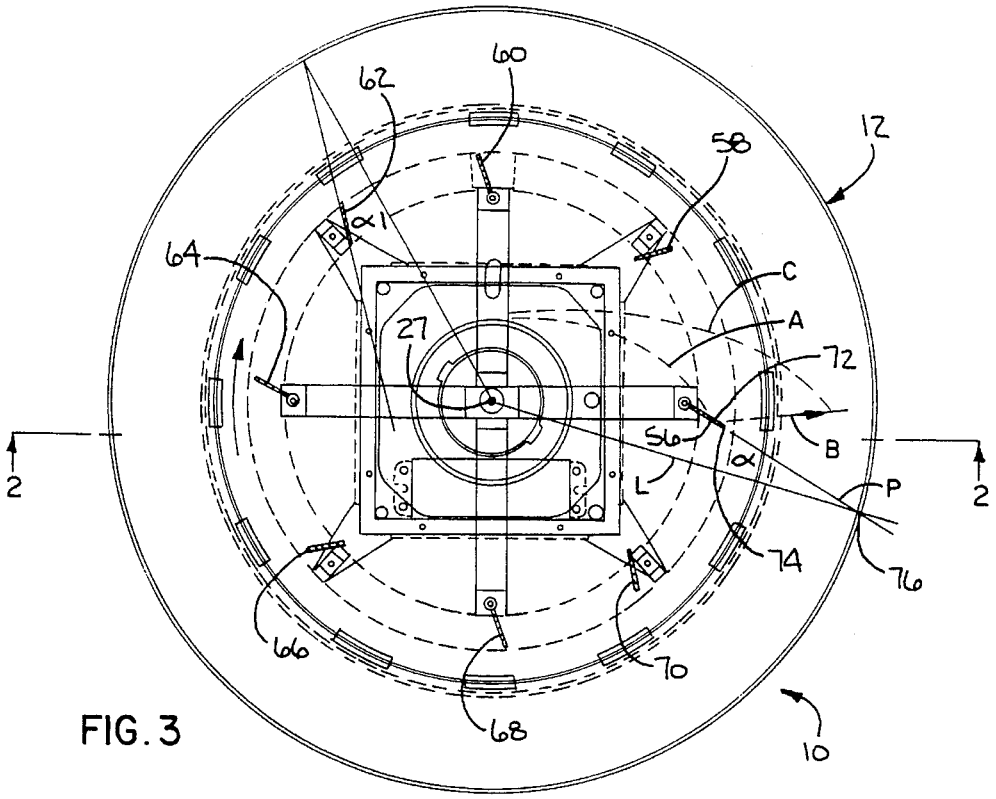
FIG. 3
FIG. 2
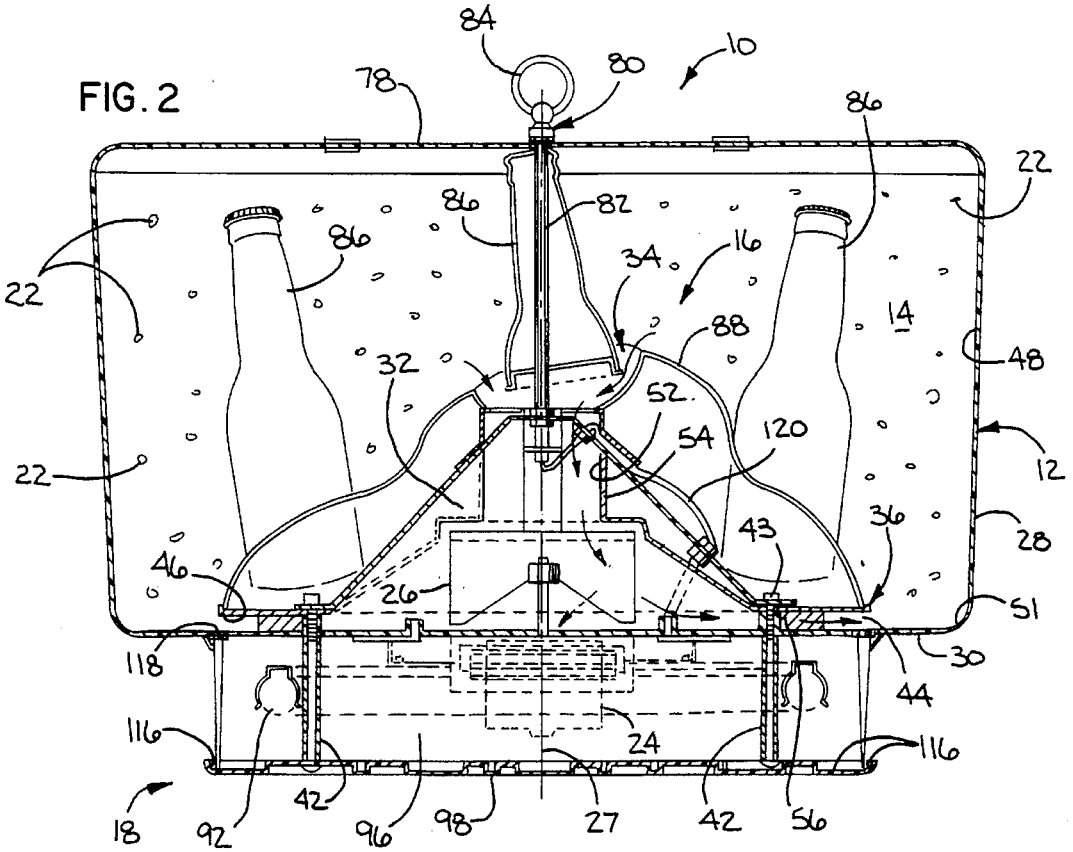

ANIMATED DISPLAY

BACKGROUND OF THE INVENTION

1. Field of the Invention

This invention relates to advertising displays, as used at point of purchase and, more particularly, to a display which uses animation to enhance its visual appeal.

2. Background Art

In the highly competitive advertising industry, designers strive to develop point of purchase advertising displays that are highly visually appealing. At the same time, the cost of these displays must be maintained within a reasonable range to allow periodic replacement, as when a company adopts a new advertising theme or wishes to prevent overexposure of the consumer to a particular display.

Conventional displays range from one dimensional, fixed displays to relatively elaborate, animated displays.

It is popular amongst some advertisers to associate their product with snow and/or ice. Simulated snowfall gives a consumer a sense that the product is cool and refreshing.

Heretofore, many advertising displays using simulated snowfall have been relatively passive in nature. U.S. Pat. Nos. 2,587,620 (Hormann) and 2,897,619 (Zens) both disclose such advertising displays.

Hormann circulates fingers through an accumulated supply of snow simulating flakes to cause the individual flakes to be elevated and deposited in front of a scene.

Zens continuously conveys simulated snow flakes to the top of a display and distributes the flakes so that they fall uniformly across the width in from of a display area.

U.S. Pat. Nos. 3,243,183 (Scranage) and 5,200,239 (Chen) both disclose systems for depositing artificial snow flakes from overhead upon a tree. Chen uses a recirculating arrangement.

Another known decorative object employs a sealed, partially clear case which contains a finite mount of liquid. A small scene and/or figure is mounted within the liquid. Discrete snow simulating particles are suspended in the liquid and have sufficient weight to fall under the force of gravity through the liquid. The user manually picks the case up and tums it upside down long enough to allow the particles to accumulate at the top of the case. By then righting the case, the particles float downwardly to simulate a shower of snow over the figure/scene.

In order for this type of system to be used in the advertising industry, the case would have to be turned upside down and righted at prescribed intervals. Thus it is relatively impractical to keep such a device "animated".

While the above structures can be employed to produce an attractive display, there are limitations built in to these displays by reason of the flakes moving downwardly principally under the force of gravity. That is, the snow simulating flakes flow relatively gently downwardly as snow would move under calm conditions.

SUMMARY OF THE INVENTION

According to the invention, an animated display is provided having a case defining a display chamber with a top and bottom. An object is provided within the display chamber so as to be visible from externally of the case. Structure is provided for continuously circulating a plurality of discrete particles through the display chamber in a pattern that extends through in excess of 180° around a vertical axis extending through the object.

In one form, the object is a three dimensional object and the discrete particles are circulated in a pattern that extends through 360° around a vertical axis extending through the object.

With the particles circulated completely around the object, the appearance can be created that the object is residing in the center of a snowstorm. It is possible to create the appearance of a severe snowstorm, with the snow particles whipping around the object.

In one form, the chamber is sealed.

The structure to effect circulation of the discrete particles may include a subchamber in the display chamber and a rotary squirrel cage fan blade on the case for drawing discrete particles into the subchamber from the display chamber at a first location and propelling the discrete particles outwardly from the subchamber into the display chamber at a second location.

The structure for continuously circulating the discrete particles may also include structure on at least one of the object and case for guiding discrete particles between the first and second locations.

The subchamber may include a passageway through a portion of the object and a space between the object and case communicating between the passageway and the display chamber. The space between the object and case may be an annular space.

The structure for continuously circulating the discrete particles may include a surface on the case that intercepts and redirects particles propelled outwardly at the second location. The surface on the case can have a concave portion opening in the direction of movement of the particles propelled outwardly at the second location.

With this arrangement, particles propelled against the case wall surface can be deflected vertically upwardly by the case wall surface.

In another aspect of the invention, the structure for continuously circulating the discrete particles causes circulation of the discrete particles in a curved path, with there being structure for interrupting movement of the discrete particles in the curved path to cause turbulent movement of the discrete particles.

With this arrangement, the flow of the particles can be changed to more realistically simulate a snowstorm wherein the movement of the particles is more random.

The structure for interrupting movement of the particles may consist of one or more vertically extending vanes. With multiple vanes employed, flat surfaces may be used to deflect the discrete particles. The angles of the flat surfaces are oriented so that the angles between the planes containing the flat vane surfaces and lines through the center axis and points where the planes intersect the walls are different. This adds further to the random nature of the pattern of the discrete particles.

In another form of the invention, an animated display is provided having a case defining a display chamber with a top and bottom. An object is provided within the display chamber and is visible from externally of the case. The case has a viewing wall with a surface bounding the display chamber. Structure is provided for continuously circulating a plurality of discrete particles through the display chamber in a pattern such that the discrete particles are propelled against the viewing wall surface at a first height, redirected upwardly by the viewing wall surface and directed downwardly to be recirculated.

In one form, the viewing wall surface is cylindrical with a vertical axis and the structure for continuously circulating the discrete particles causes the particles to be directed downwardly adjacent to the central axis of the viewing wall surface.

The discrete particles can be made from plastic, such as ground polystyrene, or other suitable material.

A light source can be provided to project light through the object or other part of the display.

To prevent clinging of the discrete particles to any part of the case, structure can be provided to dissipate static electricity on the case.

BRIEF DESCRIPTION OF THE DRAWINGS

FIG. 1 is an exploded perspective view of an animated display according to the present invention;

FIG. 2 is a cross-sectional view of the inventive display in an operative state and taken along line 2—2 of FIG. 1;

FIG. 3 is a plan view of the inventive display;

FIG. 4 is a schematic plan view of the display showing the flow pattern of discrete particles through an internal display chamber; and FIG. 5 is a schematic side elevation view of the display showing the flow pattern of discrete particles within the display chamber.

DETAILED DESCRIPTION OF THE DRAWINGS

In FIGS. 1–3, an animated display, according to the present invention, is shown at 10. The display 10 consists of a case 12 having an internal display chamber 14 within which an object 16 to be viewed is placed. A base section 18 houses an operating mechanism for the display 10. A cover section 20 is provided to seal the display chamber 14.

One objective of the present invention is to circulate discrete particles 22, as may simulate snow flakes, within the display chamber 14 around the object 16 within the display chamber 14, to give the appearance of a blizzard, with the snow swirling completely around the object 16. The means for circulating the discrete particles 22 through the display chamber 14 includes a motor 24 with a squirrel cage/centrifugal fan blade 26 that rotates about a vertical axis 27, preferably centered on the axis of a cylindrical viewing wall 28 bounding the display chamber 14. The means for continuously circulating the discrete particles 22 further includes cooperating surfaces on the object 16 and case 12 to guide the discrete particles 22 in a swirling pattern around the object 16.

The object 16 is located in the center of the display chamber 14 and defines in conjunction with the bottom chamber wall 30 a subchamber 32 which guides fluid, that is preferably air, with entrained particles 22 inwardly from the chamber 14 at a first location 34 downwardly against the fan blade 26 and radially outwardly into the chamber 14 through a full 360° from beneath the object 16 at a second location 36.

The object 16 has a base 38 which is supported by a four-legged frame 40 in the display chamber 14. Four threaded supports 42 project upwardly from the base section 18 through the bottom chamber wall 30 to allow the frame 40 and base 38 to be maintained elevated slightly above the chamber wall 30. The frame 40, with the base 38 thereon, is secured to the supports 42 by bolts 43. Resultingly, an annular space 44 is defined between the bottom wall 46 of the base 38 and the bottom chamber wall 30 to allow communication of fluid with particles 22 entrained therein radially outwardly through 360° from the subchamber 32 against the inside surface 48 of the viewing wall 28.

The air pattern at the bottom chamber wall 30 is depicted by arrows 50 in FIGS. 4 and 5. The fan blade 26 causes the air to be propelled radially outwardly and to be bent arcuately in the direction of rotation. As viewed from overhead, the blade 26 is operated in a clockwise direction.

The air with the entrained particles 22 is propelled outwardly at the second location and encounters a concave surface portion 51 of the viewing wall 28, which bends the air flow upwardly. The cylindrical surface 48 diverges from bottom to top and thereby causes an expansion upwardly of the air with the entrained particles 22.

Air moving towards the top of the display chamber 14 is drawn radially inwardly and bent downwardly by suction created by the fan blade 26 at the first location 34. The air with the entrained particles 22 is drawn downwardly through a vertical passageway 52 defined by a neck 54 on the base 38 and against the fan blade 26 which propels the air radially outwardly.

To induce turbulence to the air flow, a plurality of vanes 56, 58, 60, 62, 64, 66, 68, 70 are mounted in the space 44 between the object wall 46 and the chamber wall 30. Since the vanes are similarly constructed and located equidistantly from each other and the center axis 27, the description herein will be limited to one exemplary vane 56. The vane 56 has two oppositely facing, vertically extending flat surfaces 72, 74 which intercept air propelled radially outwardly from the fan blade 26. The paths of exemplary particles 22 are shown in dotted lines in FIG. 3. One particle may follow the curved line A as it is propelled by the fan blade 26 to impinge upon the vane surface 56. The intercepting surface 72 causes the particles 22 to rebound in the direction of line B. Another particle moving along the curved line C will pass radially outwardly without encountering the vane 56. This particle 22 may intercept the path B so that the particles 22 intermingle and move in random paths. While this simple explanation is intended to illustrate the function of the vanes 56, 70, the multiple particles 22 that would be propelled would mix and deflect randomly to produce a turbulent pattern that accurately simulates the movement of snow flakes in blizzard conditions.

Extension of the plane of the flat surface 72 intersects the viewing wall 28 at a point 76. This plane is identified as P in FIG. 3. A line L extending from the central axis 27 through the point 76 makes an angle $\alpha$ with the plane P. The angle $\alpha$ is on the order of 30°.

In a preferred form, the corresponding angles for some or all of the remaining vanes 58–70 can be different. This produces a more random particle pattern. Preferably, 2 to 4 of the vanes 56–70 have a different angle. For example, the angle $\alpha 1$ for the vane 62 is slightly different than the angle $\alpha$.

Preferably, the discrete particles 22 are made from plastic, though they can be made from other material, such as cardboard, or the like. In one form, the particles 22 are formed by ground polystyrene.

Since many of the display parts, such as the wall 28, the object 16, etc. can be made from plastic, there is a problem with buildup of static electricity as the particles 22 are circulated in the display chamber 14. As a result, there is a tendency of the particles 22 to cling to various surfaces on the display. To prevent this problem, a staticide, such as that made by ACL Incorporated, may be sprayed upon internal and/or external surfaces of the display 10. Other static inhibitors are made in the market and could be used to perform a like function.

As a further alternative, the plastic parts of the display 10 can be made with carbon particles dispersed therein. This makes the plastic conductive to facilitate grounding thereof.

Replenishing of the particles 22 and/or re-treatment of the plastic parts with staticide is made possible by the provision of a removable disk 78 on the cover section 20.

The display 10 can be mounted upon a pedestal, or other support surface, or suspended from a vertical support. In the latter case, a hanger assembly 80 is provided. The hanger assembly 80 includes an elongate rod 82 which attaches to the base 38 and projects upwardly through the disk 78 to allow the connection of a ring 84 thereto. The ring 84 can be used to suspend the display from a hook, cord, rope, chain, etc.

The nature of the object 16 can vary considerably. The object 16 shown is only exemplary of the many different objects and scenes that might be displayed. In this case, a beverage, sold in bottles 86, is incorporated into the winter theme. Identifying labels 87 are applied to the bottles 86. A skirt 88, simulating a snow bank, is draped over the base 38 and defines receptacles 90 for the individual bottles 86. The skirt 88 can be formed by a number of different techniques. For example, it might be formed in one piece in a molding process. Preferably, the skirt 88 is molded from a translucent material to allow light from a fluorescent bulb 92 in the base section 18 to be projected therethrough and into the display chamber 14.

While a two-dimensional object could be displayed effectively in the chamber 14, it is desired that the object be three-dimensional and that the pattern of the particles 22 extend through at least 180° about a vertical axis extending through the object 16 to produce the unique visual effect.

The base section 18 includes an annular wall 94 defining a chamber 96 that is closed by a bottom wall 98. The bottom wall 98 is held in place by bolts 100 extending into the supports 42.

Within the chamber 96, the motor 24 is carried on a mounting block 102. A bulb support plate 104 is mounted to the block 102 and has clips 106 to releasably accept the bulb 92 and a ballast 108 therefor.

The wall 94 is translucent and can be adorned by a translucent, message-carrying label 110. Another label 112 can be provided on the bottom of the wall 98 for decorative purposes. A decorative trim ring 114 is optionally provided on the wall 94 at the bottom edge thereof.

The bottom wall 98 has vent openings 116 to allow air to flow into the chamber 96. Vent openings 118 are provided at the top of the wail 94 to permit exhaustion of the air introduced through the vent openings 116. This arrangement keeps the chamber 96 cool with the motor 24 operated and the bulb 92 illuminated.

Power can be supplied to the motor 24 and bulb 92 through a cord 120 that projects through the rod 82 to externally of the display 10.

The foregoing disclosure of specific embodiments is intended to be illustrative of the broad concepts comprehended by the invention.

We claim:

1. An animated display comprising:

a case having a surface bounding at least a part of a display chamber, said case having a top and bottom;

an object within the display chamber that is visible from externally of the case;

a plurality of discrete particles; and means for continuously circulating the discrete particles through the display chamber in a pattern that extends through in excess of 180° around a vertical axis extending through the object, wherein the means for continuously circulating the discrete particles includes a first wall within the display chamber and extending substantially continuously around a vertically extending axis, said first wall having a first surface bounding a subchamber and a second, oppositely facing surface, said means for continuously circulating the discrete particles comprising means for continuously circulating the discrete particles in a continuous path vertically in one direction through the subchamber guidingly against the first surface of the first wall and thereafter vertically in a direction opposite to the one direction in the display chamber guidingly in a space between the case surface and the second surface on the first wall, said means for continuously circulating the discrete particles comprising means for propelling the discrete particles in a downward direction through a portion of the continuous path with a force in addition to gravitational forces acting on the discrete particles.

2. The animated display according to claim 1 wherein the object is a three dimensional object and the means for circulating the discrete particles circulates the discrete particles in a pattern that extends through 360° around a vertical axis extending through the object.

3. The animated display according to claim 1 wherein the display chamber is a sealed chamber.

4. The animated display according to claim 1 wherein the means for continuously circulating the discrete particles includes a rotary squirrel cage fan blade on the case for drawing discrete particles into the subchamber from the display chamber at a first location and propelling the discrete particles outwardly from the subchamber into the display chamber at a second location.

5. The animated display according to claim 4 wherein the surface on the case intercepts and redirects discrete particles propelled outwardly at the second location.

6. The animated display according to claim 5 wherein the surface on the case has a concave portion opening in the direction of movement of the discrete particles propelled outwardly at the second location.

7. The animated display according to claim 4 wherein the subchamber includes a passageway through a portion of the object and a space between the object and case communicating between the passageway and the display chamber.

8. The animated display according to claim 7 wherein the space between the three dimensional object and case comprises an annular space.

9. The animated display according to claim 1 wherein the case has a viewing wall with a cylindrical inside surface portion having a vertical center axis, the means for continuously circulating the discrete particle comprises means for circulating the discrete particles in a curved path and there are means on the case for interrupting movement of the discrete particles in the curved path to cause turbulent movement of the discrete particles.

10. The animated display according to claim 1 wherein the case has a wall with a surface bounding the display chamber and the means for continuously circulating the discrete particles comprises means for propelling discrete particles against the case wall surface so that the discrete particles are deflected vertically upwardly by the case wall surface.

11. An animated display comprising:

a case defining a display chamber with a top and bottom;

an object within the display chamber that is visible from externally of the case;

a plurality of discrete particles; and means for continuously circulating the discrete particles through the display chamber in a pattern that extends through in excess of 180° around a vertical axis extending through the object, wherein the case has a viewing wall with a cylindrical inside surface having a vertical center axis, the means for continuously circulating the discrete particle comprises means for circulating the discrete particles in a curved path and there are means on the case for interrupting movement of the discrete particles in the curved path to cause turbulent movement of the discrete particles, wherein the means for interrupting movement of the discrete particles comprise at least one vertically extending vane.

12. The animated display according to claim 11 wherein the means for interrupting movement of the discrete particles comprises first and second vanes with flat surfaces oriented so that the angles between planes containing the flat vane surfaces and lines through the vertical center axis and points where the planes intersect the viewing wall are different.

13. An animated display comprising:

a case defining a display chamber with a top and bottom;

an object within the display chamber that is visible from externally of the case, there being a viewing wall on the case having a surface bounding the display chamber;

a plurality of discrete particles; and means for continuously circulating the discrete particles in a continuous path through the display chamber, said means for continuously circulating the discrete particles includes a first wall within the display chamber and extending around a vertically extending axis so as to bound a subchamber, said first wall having a top and bottom, said means for continuously circulating the discrete particles comprising means for continuously circulating the discrete particles in an endless path vertically in one direction through the subchamber, around one of the top and bottom of the first wall, vertically in a direction opposite to the one direction, around the other of the top and bottom of the first wall and back into the subchamber for recirculating, while at the same time moving the discrete particles in a direction around the vertically extending axis as they move in the endless path.

14. The animated display according to claim 13 wherein the viewing wall surface is cylindrical with a vertical axis and the means for continuously circulating the discrete particles comprises means for continuously circulating the discrete particles such that the discrete particles are directed downwardly adjacent to the central axis of the viewing wall surface.

15. The animated display according to claim 13 wherein the discrete particles are made from plastic.

16. The animated display according to claim 13 wherein the discrete particles are made from ground expanded polystyrene.

17. The animated display according to claim 13 wherein the display chamber is a sealed chamber.

18. The animated display according to claim 13 wherein the subchamber extends through the object.

19. The animated display according to claim 18 wherein the object has a shape that diverges from top to bottom in the display chamber and the particles moving in the endless path move in the space between the object and the case.

20. The animated display according to claim 13 including means on the case for projecting light through the object.

21. The animated display according to claim 13 wherein the means for continuously circulating the discrete particles includes a rotary squirrel cage fan blade.

22. The animated display according to claim 13 wherein the viewing wall has a vertical center axis, the means for continuously circulating the discrete particles comprises means for circulating the discrete particles in a curved path and there are means on the case for interrupting movement of the discrete particles in the curved path to cause turbulent movement of the discrete particles.

23. The animated display according to claim 13 wherein the means for interrupting movement of the discrete particles comprises means for circulating the discrete particles in the display chamber completely around the object.

24. The animated display according to claim 13 including means for dissipating static electricity on the case.

25. The animated display according to claim 13 wherein the means for continuously circulating the discrete particles comprises means for continuously circulating the discrete particles so that the discrete particles are propelled against the viewing wall surface at a first height, redirected upwardly by the viewing wall surface and directed downwardly to be recirculated.

26. The animated display according to claim 13 wherein the means for continuously circulating the discrete particles comprises means for continuously moving the particles without stopping as they move, in the continuous path.

27. An animated display comprising:

a case defining a display chamber with a top and bottom;

an object within the display chamber that is visible from externally of the case, there being a viewing wall on the case having a surface bounding the display chamber;

a plurality of discrete particles; and means for continuously circulating the discrete particles through the display chamber in a pattern such that the discrete particles are propelled against the viewing wall surface at a first height, redirected upwardly by the viewing wall surface and directed downwardly to be recirculated, wherein the viewing wall has a vertical center axis, the means for continuously circulating the discrete particles comprises means for circulating the discrete particles in a curved path and there are means on the case for interrupting movement of the discrete particles in the curved path to cause turbulent movement of the discrete particle, further wherein the means for interrupting movement of the discrete particles comprises at least one vertically extending vane.

28. The animated display according to claim 24 wherein the means for interrupting movement of the discrete particles comprises first and second vanes with flat surfaces oriented so that the angles between the planes containing the flat vane surfaces and lines through the center axis and points where the planes intersect the viewing wall are different.

* * * * *